US006734611B2

(12) United States Patent
Bucher

(10) Patent No.: US 6,734,611 B2
(45) Date of Patent: May 11, 2004

(54) TENSION MASK ASSEMBLY FOR A CATHODE RAY TUBE HAVING MASK DETENSIONING

(75) Inventor: Alan Weir Bucher, Manheim, PA (US)

(73) Assignee: Thomson Licensing S. A., Boulogne Cedex (FR)

( * ) Notice: Subject to any disclaimer, the term of this patent is extended or adjusted under 35 U.S.C. 154(b) by 8 days.

(21) Appl. No.: 09/934,619

(22) Filed: Aug. 22, 2001

(65) Prior Publication Data

US 2003/0038579 A1 Feb. 27, 2003

(51) Int. Cl.[7] ..... H01J 29/80
(52) U.S. Cl. ..... 313/407; 313/404
(58) Field of Search ..... 313/402, 404, 313/405, 407; 445/37, 30

(56) References Cited

U.S. PATENT DOCUMENTS 4,551,651 A * 11/1985 van der Ven ..... 313/402
5,952,774 A 9/1999 Diven et al. ..... 313/402
6,084,342 A 7/2000 Ragland, Jr. ..... 313/407
6,246,164 B1 6/2001 Heyman et al. ..... 313/407

* cited by examiner

*Primary Examiner*—Ashot Patel
*Assistant Examiner*—Glenn Zimmerman
(74) *Attorney, Agent, or Firm*—Joseph S. Tripoli; Joseph J. Laks; Carlos M. Herrera

(57) ABSTRACT

A cathode ray tube includes a tension mask attached to a rectangular mask frame assembly that has two longs sides paralleling a central major axis thereof and two short sides paralleling a central minor axis thereof. A pair of support blade members are attached each to one of the long or short sides at a central location. Each support blade member includes an inner edge having of a plurality of first sides formed from a relatively low coefficient of thermal expansion material and an outer edge having a second side formed of a material having a relatively high coefficient of thermal expansion. Each edge having a centroid separated from each other along the minor axis.

7 Claims, 2 Drawing Sheets

FIG. 3
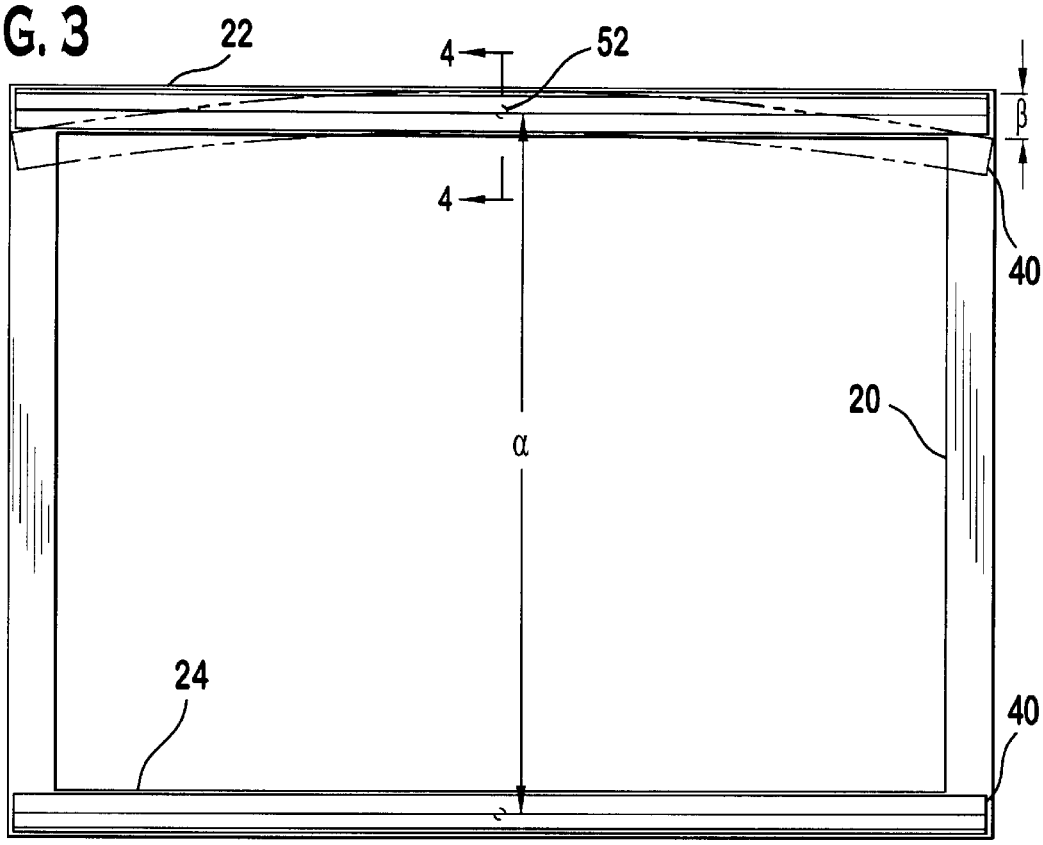
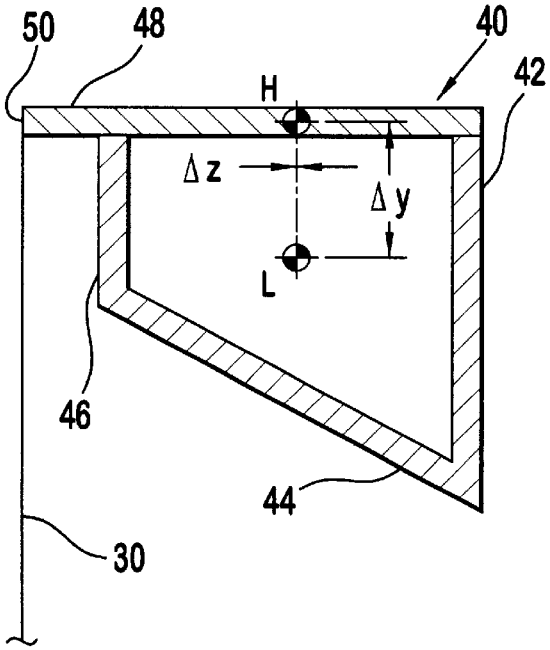
FIG. 4
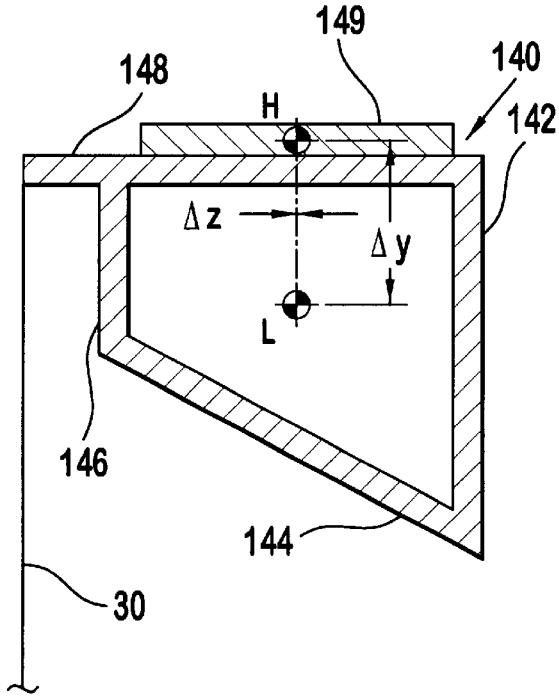
FIG. 5

TENSION MASK ASSEMBLY FOR A CATHODE RAY TUBE HAVING MASK DETENSIONING

FIELD OF THE INVENTION

This invention relates generally to cathode ray tubes, and more particularly to tension mask assemblies having detensioning features.

BACKGROUND OF THE INVENTION

A color cathode ray tube, or CRT, includes an electron gun for forming and directing three electron beams to a screen of the tube. The screen is located on the inner surface of the faceplate panel of the tube and is made up of an array of elements of three different color-emitting phosphors. A shadow mask, which may be either a formed mask or a tension mask having strands, is located between the electron gun and the screen. The electron beams emitted from the electron gun pass through apertures in the shadow mask and strike the screen causing the phosphors to emit light so that an image is displayed on the viewing surface of the faceplate panel.

One type of CRT has a tension mask comprising a set of strands that are tensioned onto a mask support frame to reduce their propensity to vibrate at large amplitudes under external excitation. Such vibrations would cause gross electron beam misregister on the screen and would result in objectionable image anomalies to the viewer of the CRT.

The mask stress required to achieve acceptable vibration performance is below the yield point of the mask material at tube operating temperature. However, at elevated tube processing temperatures, the mask's material properties change and the elastic limit of the mask material is significantly reduced. In such a condition, the mask stress exceeds the elastic limit of the mask material and the material is inelastically stretched. When the tube is cooled after processing, the strands are longer than before processing and the mask frame is incapable of tensing the mask strands to the same level of tension as before processing. Another common problem with tension mask frame assemblies occurs when the mask strand material has a lower coefficient of thermal expansion than the mask support frame material. In such a case, tension on the mask strand increases during thermal processing causing more inelastic strain.

One detensioning system utilizes a dual compliant mask frame having a pair of support blade members centrally mounted on opposite sides of a frame wherein, tension is relieved at the center of the support blade member. Detensioning of the tension mask strands at the center when using a dual compliant frame may result in relatively greater tension on the strands toward the outsides or edges of the blade. In order to achieve a more uniform detensioning, in addition to the detensioning at the center, further detensioning is required at the edges of the mask.

It is therefore desirable to develop a mask frame assembly that allows the pattern and degree of the mask detensioning to be adjusted during the thermal cycle used in the manufacturing process of a CRT.

SUMMARY OF THE INVENTION

A tension mask assembly is provided having a frame consisting of two long sides disposed parallel to a central major axis and two short sides disposed parallel to a central minor axis which is orthogonal to the major axis. Support blade members are fixed to the frame along a central location of the long sides. Each support blade member includes an inner edge having sides formed of relatively low coefficient of thermal expansion material and an outer edge having at least one side or detensioning member formed of a relatively high coefficient of thermal expansion material. The centroid of each edge is separated from each other along the central minor axis.

BRIEF DESCRIPTION OF THE DRAWINGS

The invention will now be described by way of example with reference to the accompanying figures of which:

FIG. 3 is a front diagrammatic view the tension mask frame assembly showing a support blade member at an elevated temperature.

FIG. 4 is a cross sectional view taken along the line 4—4 of FIG. 3.

FIG. 5 is a cross sectional view similar to FIG. 4 showing an alternative support blade member.

DETAILED DESCRIPTION OF THE INVENTION

Figure 1:
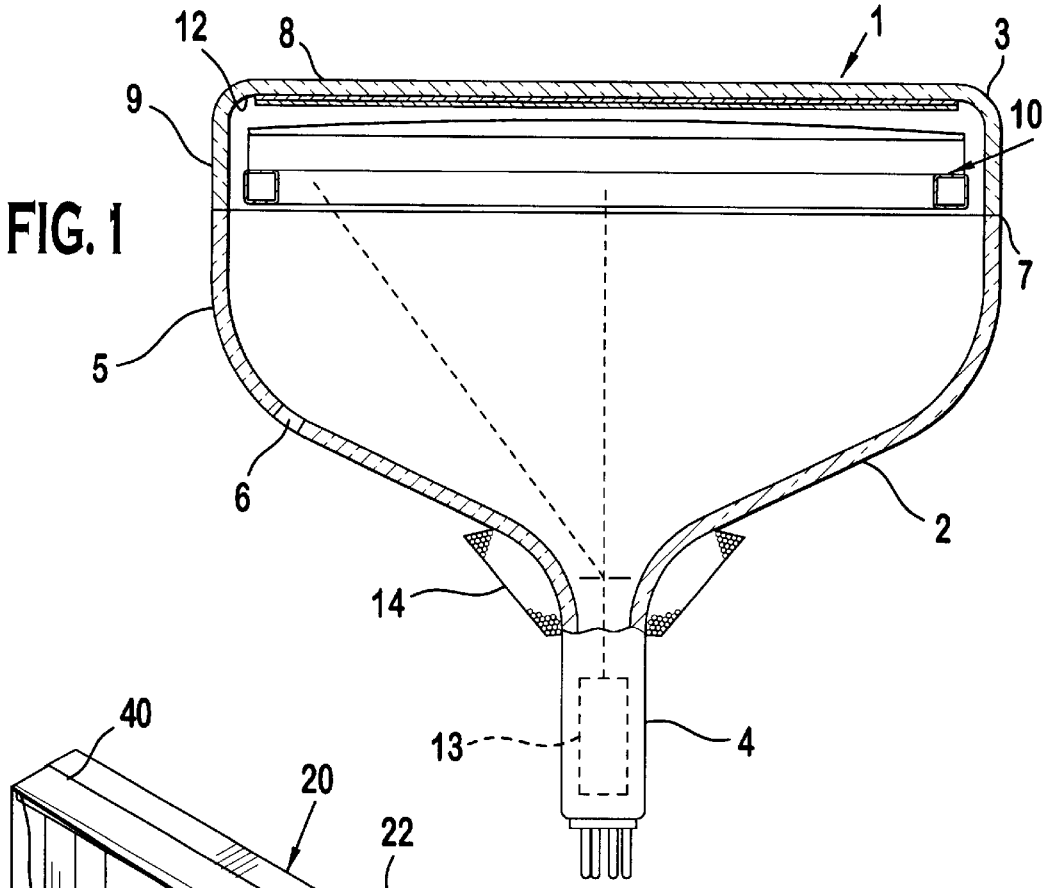
FIG. 1 is a cross sectional view of a CRT showing a tension mask frame assembly.

FIG. 1 shows a cathode ray tube (CRT) 1 having a glass envelope 2 comprising a rectangular faceplate panel 3 and a tubular neck 4 connected by a funnel 5. The funnel 5 has an internal conductive coating (not shown) that extends from an anode button 6 toward the faceplate panel 3 and to the neck 4. The faceplate panel 3 comprises a viewing faceplate 8 and a peripheral flange or sidewall 9, which is sealed to the funnel 5 by a glass frit 7. A three-color phosphor screen 12 is carried by the inner surface of the faceplate panel 3. The screen 12 is a line screen with the phosphor lines arranged in triads, each of the triads including a phosphor line of each of the three colors. A tension mask frame assembly 10 is removably mounted in predetermined spaced relation to the screen 12. An electron gun 13, shown schematically by dashed lines in FIG. 1, is centrally mounted within the neck 4 to generate and direct three inline electron beams, a center beam and two side or outer beams, along convergent paths through the tension mask frame assembly 10 to the screen 12.

The CRT 1 is designed to be used with an external magnetic deflection yoke 14 shown in the neighborhood of the funnel-to-neck junction. When activated, the yoke 14 subjects the three beams to magnetic fields which cause the beams to scan horizontally and vertically in a rectangular raster over the screen 12.

Figure 2:
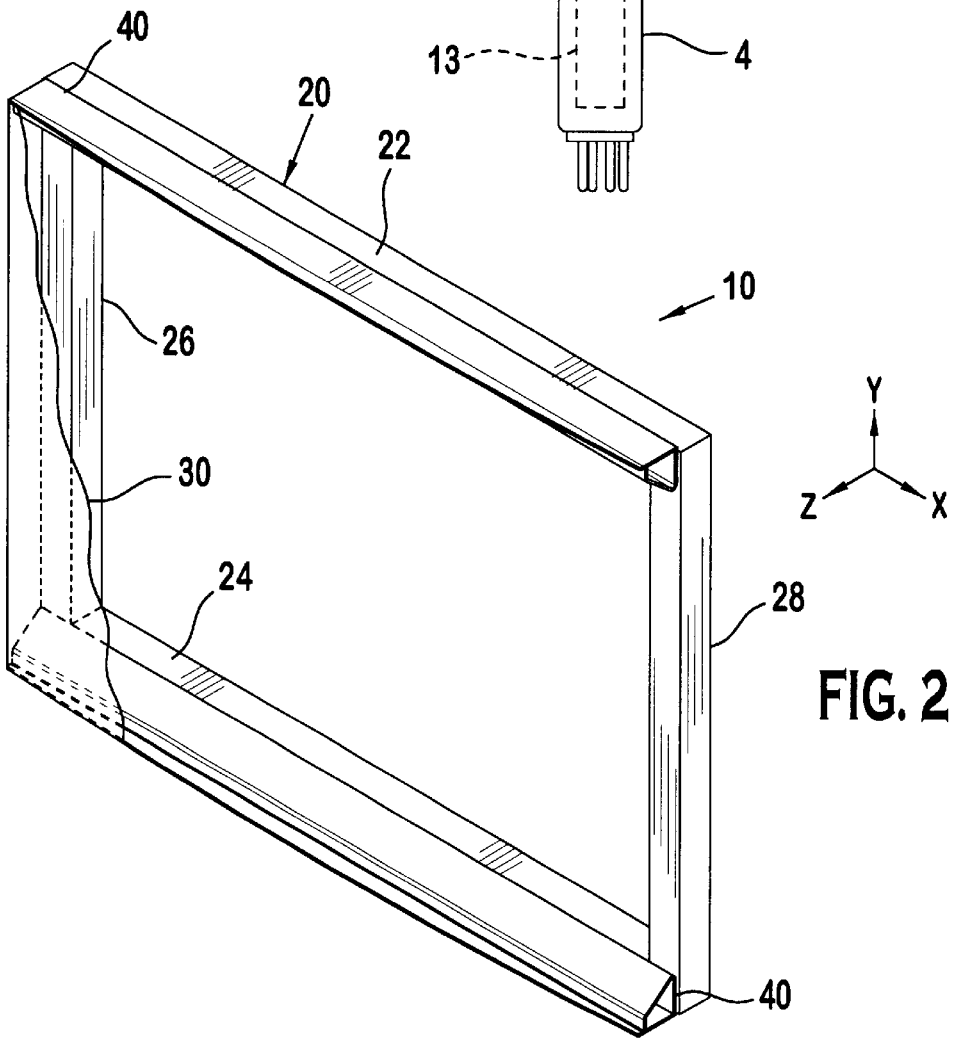
FIG. 2 is a perspective view of the tension mask frame assembly.

The tension mask frame assembly 10, as shown in FIG. 2, includes two long sides 22 and 24, and two short sides 26 and 28. The two long sides 22, 24 of the tension mask frame assembly 10 are parallel to a central major axis, X, of the tube; and the two short sides 26, 28 parallel a central minor axis, Y, of the tube. The two long sides 22, 24 and two short sides 26, 28 form a continuous planar mask support frame 20 along those major and minor axes.

The frame assembly 10 includes an apertured tension shadow mask 30 (shown here diagrammatically as a sheet for simplicity) that contains a plurality of metal strips (not shown) having a multiplicity of elongated slits (not shown) therebetween that parallel the minor axis, Y, of the tube. The mask 30 is fixed to a pair of support blade members 40 which are fastened to the frame 20 at attachment points 52. The support blade members 40 may vary in height from the center of each support blade member 40 longitudinally to the ends of the support blade member 40 to permit the best curvature and tension compliance over the tension shadow mask 30.

Referring now to FIGS. 3 and 4, the support blade member 40 will be described in greater detail. FIG. 4 shows a cross sectional view of the support blade member 40 taken along the line 4—4 of FIG. 3. The support blade member 40 is a closed structure consisting of a plurality of first sides 42, 44, 46 formed of a material having a relatively low coefficient of thermal expansion hereinafter referred to as low expansion material and a side 48 consisting of a material having a relatively high coefficient of thermal expansion hereinafter referred to as high expansion material. Each of the sides 42, 44, 46, 48 may be either bent from a single piece, welded together, or attached by any other suitable means. The mask 30 is applied at a mask receiving edge 50 along the side 48. The support blade member 40 is attached to the subframe 20 at attachment points 52 located approximately at the center of opposing frame long sides 22, 24.

FIG. 3 illustrates that these attachment points 52 are positioned at a distance a from each other. This distance a increases during the thermal heating cycle of the manufacturing process due to thermal expansion of the frame 20. In a dual compliant frame arrangement, the frame 20 is designed such that the long sides 22, 24 bow inward toward each other when heated to relieve tension on the mask 30. Since the support blade members 40 are flexible and have some compliance, the center of the mask is detensioned more than the edges. As best shown in FIG. 3 the support blade member 40 deflects or curls from its resting position toward the major axis, X, indicated by solid lines to a deformed position indicated by dashed lines. The deformation occurs during heating such that the distal ends of the support blade member 40 move a distance β indicated in FIG. 3. This deformation is caused by the high expansion material being positioned on the outer edges of the support blade member 40 which acts as a detensioning feature because the outer edge essentially expands more rapidly than the inner edge. The movement indicated by the distance β relieves the increased tension at the distal ends of the support blade member 40 and along the edges of the mask 30 thereby providing the opportunity for detensioning the edges of the mask independently from the center and thus allowing the pattern and degree of mask detensioning to be adjusted by the amount of blade detensioning used. It should be understood that while deformation is shown in a single support blade member 40 at the top of FIG. 3, the bottom support blade member 40 also deforms similarly during heating.

The effect of the invention will be described with reference to FIG. 4. A pair of centroids L, H are shown wherein L is the centroid of the first sides 42, 44, 46 which are formed of low expansion material while H indicates the centroid of the side 48 formed of high expansion material. The centroids L, H are separated from each other along the minor axis Y and both lie within the XY plane with no separation in the Z plane. The deformation of the support blade member 40 during heating is therefore controlled in the X, Y plane by the distance ΔY while remaining stable in the Z direction as indicated by ΔZ=O.

FIG. 5 shows an alternative embodiment of the support blade member 140. This support blade member 140 is structurally similar to the support blade member 40 of FIG. 4 except that the plurality of first sides 142, 144, 146 and the side 148 are formed from the same material to create the closed structure. This material is similarly a relatively low coefficient of thermal expansion material as was described above. A detensioning member or high coefficient member 149 is added along the side 148. It is formed of a material having a relatively high coefficient of thermal expansion. This high expansion member 149 may be welded or applied to the side 148 by other known techniques such as mechanical fasteners or adhesives. The high coefficient member 149 preferably has a rectangular cross section and extends over a majority of the side 148. It should be understood by those reasonably skilled in the art however that while shown in the cross section to cover a majority of the side, it is not necessary that this cross section extend over the entire length of the support blade member 140. The area of the side 148 which is covered by the high expansion member 149 may be adjusted to achieve various curl characteristics during heating. Altenatively, the high expansion member 149 may be segmented and secured along the length of the support blade member 140. This variation results in different amounts of detensioning on the mask at the distal ends of the support blade member 140. The effect of this alternative embodiment is similar to that described above with reference to FIG. 4 wherein deformation of the support blade member 140 during heating is controlled by the distance ΔY between the centroids L, H while remaining stable in the Z direction.

An advantage of the present invention is the ability to detension the edge of the mask using the support blade member which is attached to the frame at a central location. By adjusting the length of the high coefficient member the amount of detensioning at the edges may be controlled. A high expansion member extending over a longer portion of the support blade member will result in greater detensioning at the edges than a relatively shorter high coefficient member.

What is claimed is:

1. A tension mask assembly for use in a CRT comprising:

a mask support frame formed by a pair of long sides and a pair of short sides attached together at their ends, the long sides extending parallel to a central major axis and the pair of short sides extending parallel to a central minor axis; and, a pair of support blade members for securing a tension mask, each of said support blade members being attached to a respective one of the long sides at a central attachment point, the support blade members each including a plurality of first sides formed of a first coefficient of thermal expansion material and defining a first centroid, and further including a second side, the second side being secured to the first sides and formed of a second coefficient of thermal expansion material and defining a second centroid, the first and second centroid being generally defined by a adjacent cross-sections of the first sides and second side of said each of the support blade members, the first and second centroid separated at a predetermined distance from each other along the minor axis whereby the first and second centroids remain in alignment during thermal deflection of the support blade members.

2. The tension mask assembly of claim 1 wherein the plurality of first sides of the support blade members form a closed structure.

3. A tension mask assembly for use in a CRT having a substantially rectangular mask support frame including a central major axis and a central minor axis perpendicular to each other, the frame formed from a pair of opposing long sides extending in parallel to the major axis and a pair opposing short sides extending in parallel to the minor axis, a support blade member to which a tension mask is attached and supported to the frame at an attachment point along one pair of opposing sides, the support blade member comprising:

an inner edge facing the central major axis and formed from a material having a first coefficient of thermal expansion; and, an outer edge formed from a second material having a relatively greater coefficient of thermal expansion than the inner edge and being fixed to the inner edge wherein the centroid of the inner edge and the centroid of the outer edge are separated along the minor axis.

4. The tension mask assembly of claim 3 wherein the second side of the outer edge extends over a portion of the inner edge.

5. A tension mask assembly of claim 3 wherein the tension mask is secured to the outer edge of the support blade member.

6. The support blade member of claim 3 wherein the outer edge extends along a portion of the inner edge whereby the distal ends of the support blade member curl inward toward the major axis during thermal heating.

7. The support blade member of claim 3 wherein the outer edge comprises a plurality of detensioning members.

* * * * *